US005169361A

United States Patent [19]

Hsu

[11] Patent Number: 5,169,361

[45] Date of Patent: Dec. 8, 1992

[54] HYDRAULIC CYLINDER ASSEMBLY FOR CLIMBING EXERCISERS

[76] Inventor: Hsien-Long Hsu, No. 76-4, Jeu Kuang Rd., Chung Ho City, Taipei Hsien, Taiwan

[21] Appl. No.: 894,548

[22] Filed: Jun. 5, 1992

[51] Int. Cl.[5] ..... A63B 22/04

[52] U.S. Cl. ..... 482/53; 482/111

[58] Field of Search ..... 482/51, 52, 53, 111, 482/112, 113, 148, 56, 37; 128/25 R

[56] References Cited

U.S. PATENT DOCUMENTS 2,099,594 5/1937 Clem ..... 128/25 R 4,651,986 3/1987 Wang ..... 482/112

4,681,316 7/1987 DeCloux ..... 482/53

*Primary Examiner*—Stephen R. Crow

*Attorney, Agent, or Firm*—Varndell Legal Group

[57] ABSTRACT

A hydraulic cylinder assembly comprising two hydraulic cylinders mounted on the frame of a climbing exerciser and connected by a control switch, said hydraulic cylinders each having an eye end piston rod inserted in an oil pipe, said eye end piston rod having a top end formed into an eye end respectively coupled with a L-shaped handlebar and a L-shaped pedal rod, and a bottom end formed into a screw rod fastened with a piston and locked by a locknut. By means of the aforementioned arrangement, the pedal and the handlebar of the same side are synchronously moved up and down.

1 Claim, 3 Drawing Sheets

HYDRAULIC CYLINDER ASSEMBLY FOR CLIMBING EXERCISERS

BACKGROUND AND SUMMARY OF THE INVENTION

The present invention relates to a hydraulic cylinder assembly for climbing exercisers.

A variety of climbing exercisers are known and widely used in training the muscles of the hands and the legs. In these climbing exercisers, the pedals and the handlebars are alternatively moved up and down, namely, the handlebar and the pedal of the same side are not synchronously moved up and down, and therefore less exercising effect is produced. The present invention has been accomplished to eliminate this disadvantage.

It is therefore an object of the present invention to provide a hydraulic cylinder assembly for climbing exercisers which produces good exercising effect by letting the pedal and the handlebar of the same side to be synchronously moved up and down. It is another object of the present invention to provide a hydraulic cylinder assembly which is simple in structure and inexpensive to manufacture.

DETAILED DESCRIPTION OF THE PREFERRED EMBODIMENT

Figure 1:
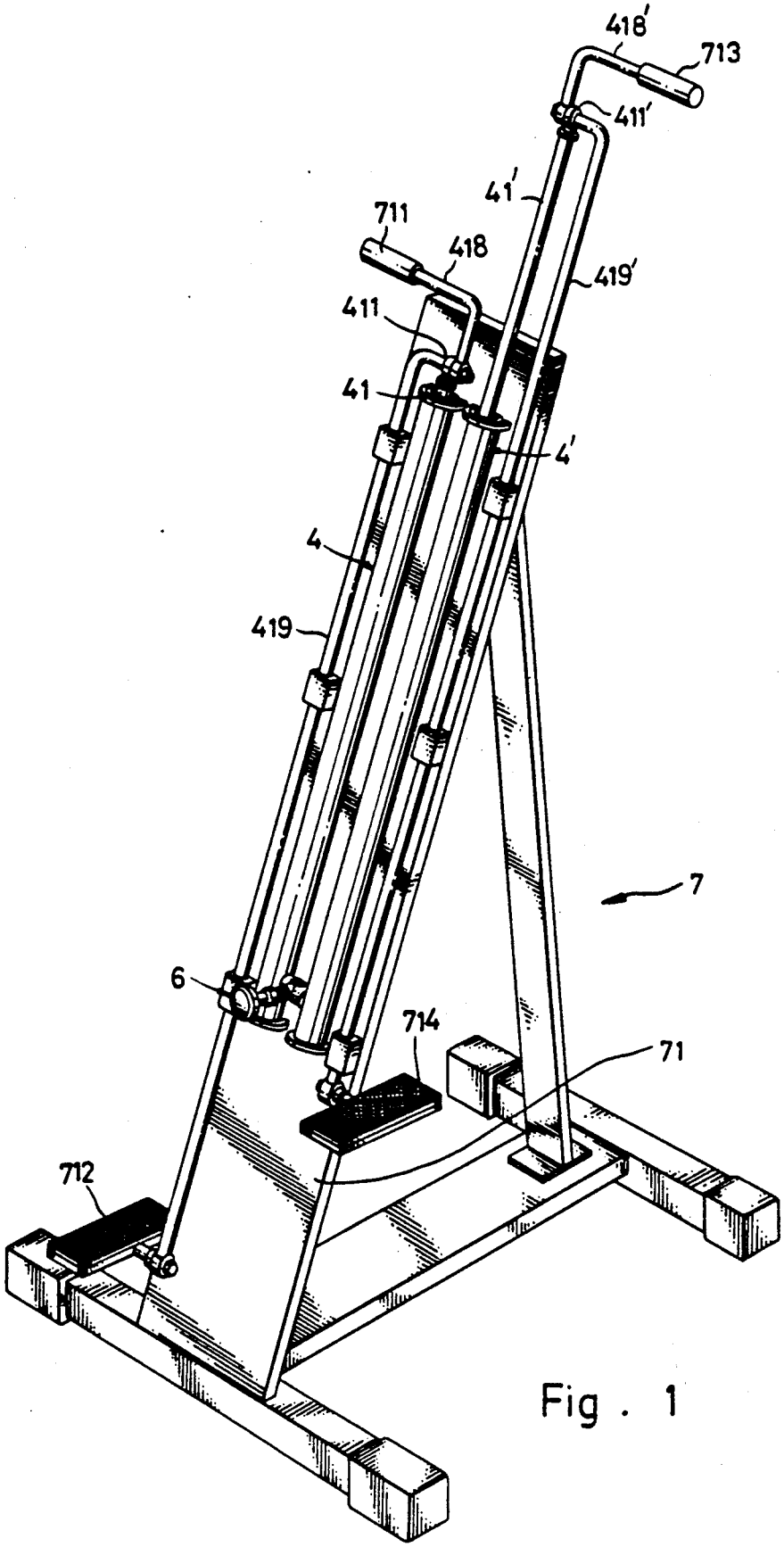
FIG. 1 is an elevational view of a climbing exerciser as constructed in accordance with the present invention.
Figure 2:
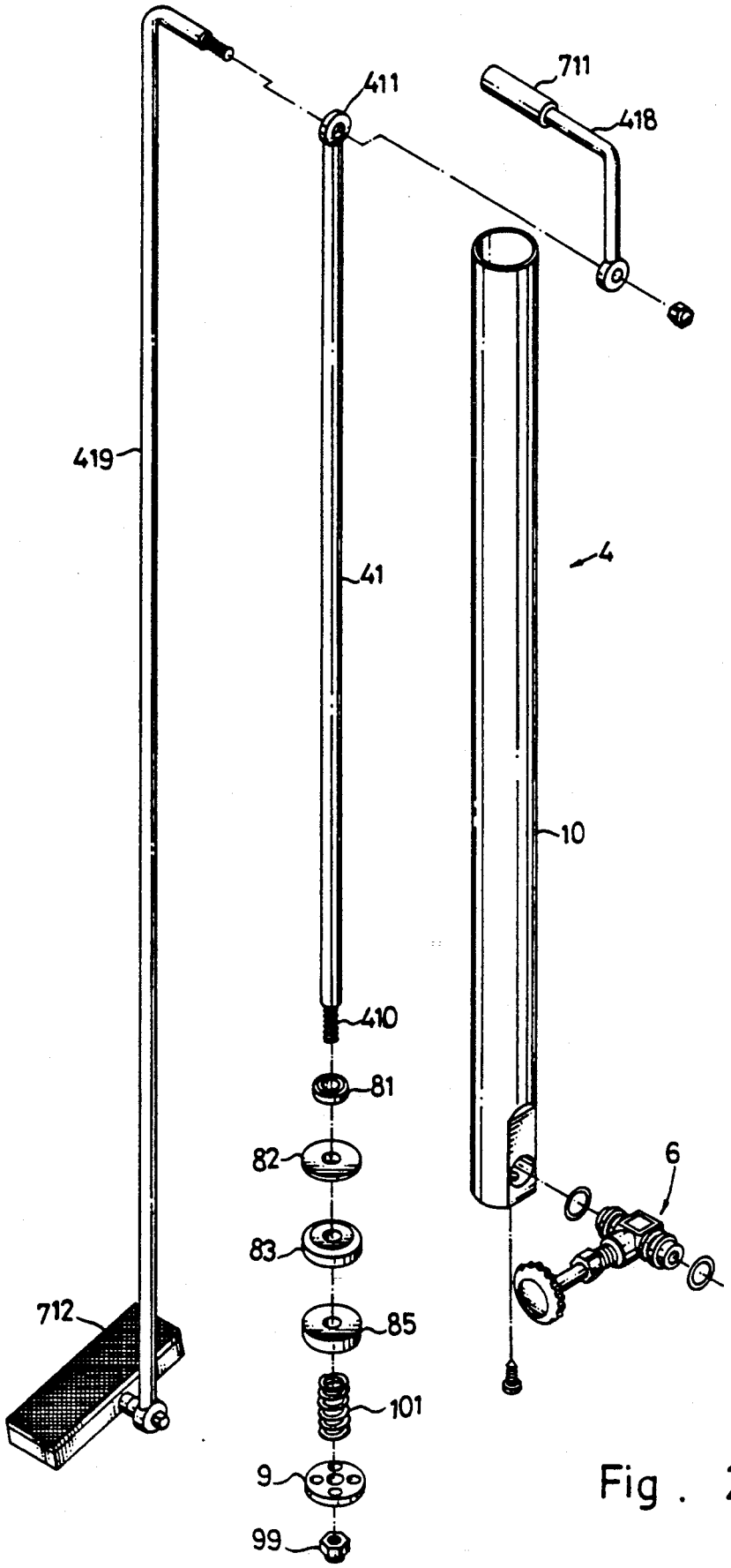
FIG. 2 is an exploded view of the preferred embodiment of the hydraulic cylinder assembly of the present invention.
Figure 3:
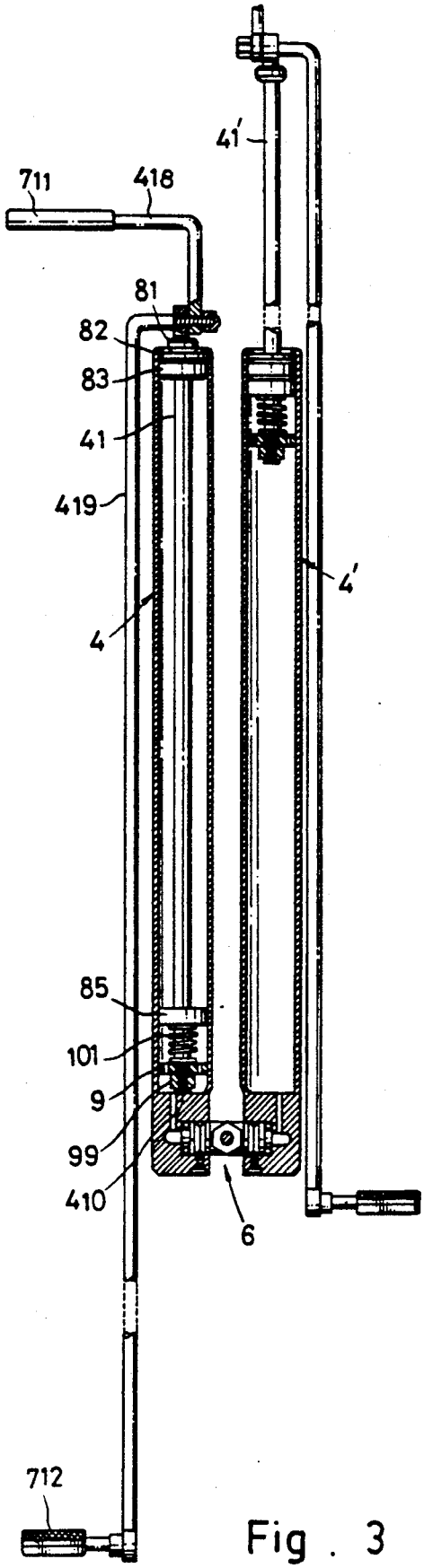
FIG. 3 is a longitudinal sectional view of the preferred embodiment of the hydraulic cylinder assembly of the present invention.

Referring to FIG. 1, 2 and 3, two hydraulic cylinders 4, 4' are mounted on the frame 71 of a climbing exerciser 7 and connected by a control switch 6. The hydraulic cylinders 4, 4' have eye end piston rods 41, 41' respectively inserted in oil pipes 10. The eye ends 411, 411' of the eye end piston rods 41, 41' are extended out of the hydraulic cylinders 4, 4' at the top and respectively coupled with L-shaped handlebars 418, 418' and L-shaped pedal rods 419, 419', wherein the handlebars 418, 418' are respectively attached with rubber grips 711, 713 for comfortable and positive grip; the opposite ends of the pedal rods 419, 419' are coupled with pedals 712, 714 for stepping.

Referring to FIGS. 2 and 3 again, the hydraulic cylinder 4 or 4' is comprised of a piston rod 41, 41' inserted through a small cushion ring 81, a big cushion ring 82, an oil seal ring 83, a bearing 85, a spring coil 101 and a center hole (not indicated) on a piston 9 and fastened up with a locknut 99. As indicated, the piston rod 41 or 41' has a bottom end formed into a screw rod 410. The piston 9 is fastened to the screw rod 410 and tightly locked in place by the locknut 99. When assembled, the cushion rings 81, 82 and the oil seal ring 83 are fixedly fastened inside the oil pipe 10 at the top, the bearing 85 is fixedly fastened inside the oil pipe 10 at a lower end above the spring coil 101. After the filling of a hydraulic oil in the hydraulic cylinders 4, 4', the pedals 712, 714 can be alternatively rotated. While stepping on the pedals 712, 714, only the piston 9 and the locknut 99 are carried by the piston rod 41 to move up and down alternatively.

By means of the aforesaid arrangement, the pedal and the handlebar of the same side are synchronously moved up and down.

What is claimed is:

1. A hydraulic cylinder assembly comprising two hydraulic cylinders mounted on the frame of a climbing exerciser and connected by a control switch, and characterized in that said hydraulic cylinders each comprises an eye end piston rod inserted in an oil pipe, said oil pipe having a small cushion ring, a big cushion ring and an oil seal ring fastened on the inside at a top end thereof, and a bearing fastened on the inside of said oil pipe at a lower nd, said eye end piston rod having a top end formed into an eye end respectively coupled with a L-shaped handlebar and a L-shaped pedal rod, and a bottom end formed into a screw rod fastened with a piston and locked by a locknut.

* * * * *